United States Patent [19]

Knapp et al.

[11] 4,058,412

[45] Nov. 15, 1977

[54] APPARATUS FOR OPENING AND WASHING CANS

[75] Inventors: Merton C. Knapp; Charles Rex Galloway, both of Mount Ayr, Iowa

[73] Assignee: Green Hills, Inc., Mount Ayr, Iowa

[21] Appl. No.: 647,452

[22] Filed: Jan. 8, 1976

[51] Int. Cl.[2] ..... B08B 9/04

[52] U.S. Cl. ..... 134/24; 134/62; 134/88; 134/104

[58] Field of Search ..... 134/22 R, 24, 62, 88, 134/89, 104, 166 R, 167 R

[56] References Cited

U.S. PATENT DOCUMENTS

| | | | |
|---|---|---|---|
| 2,491,516 | 12/1949 | Piggot et al. | 134/62 X |
| 2,668,550 | 2/1954 | Burge | 134/62 |
| 3,531,323 | 3/1967 | Carpenter et al. | 134/22 R X |

*Primary Examiner*—Arthur D. Kellogg
*Attorney, Agent, or Firm*—Zarley, McKee, Thomte, Voorhees & Sease

[57] ABSTRACT

A device for washing a can comprising a support for supporting the can on one of its lateral sides for sliding movement from a prepunch position to a punch position. A knife is positioned adjacent the support and has a cutting edge presented toward the bottom of the can so that the knife will destructively pierce the bottom of the can whenever the can is manually forced against the knife. The knife is shaped to provide a channel for liquid contents of the can to drain therefrom whenever the can is pierced by the knife. A spray nozzle is mounted with respect to the knife so as to protrude within the interior of the can whenever the knife pierces the can. A timing device causes the spray to spray the interior of the can throughout a 30-second cycle.

13 Claims, 6 Drawing Figures

APPARATUS FOR OPENING AND WASHING CANS

SUMMARY OF THE INVENTION

This invention relates to a method and means for opening and washing cans containing dangerous chemicals such as pesticides, insecticides, or herbicides.

Pesticides, herbicides, and other dangerous chemicals are often contained in cans. Disposal of these cans is a problem from a safety standpoint inasmuch as the cans must be cleansed and purged of the dangerous chemicals before their disposal. Many governmental regulations and agricultural pesticide industry regulations require triple rinsing of the cans after emptying their contents prior to disposal. Some state regulations require that certain restricted and classified pesticides be removed from their containers via a closed loop system whereby the person handling the product cannot come into accidental contact with the product. The present invention opens the can or container from the bottom with a specially designed knife which produces a hole approximately two inches in diameter. The hole is cut in such a manner as to leave attached the pierced blank from the container bottom on the inside of the container. The punch or knife opens the container to the extreme outside plane of the can so that while the can is in an inclined attitude, the entire contents of the container are permitted to drain from its interior.

Following draining of the contents from the container, the interior of the vessel or can is automatically rinsed via a pressure water spray controlled with electronic solenoids. The entire system is controlled by a series of time clock systems which are energized manually after the can is placed into its proper punched position.

The entire cycle runs for 30 seconds for each container. This cycle develops as follows: 10 second after energizing the clock, a controlling microswitch opens a solenoid valve for a period of four seconds during which the entire interior of the pesticide container is sprayed with water. Next follows a four-second rinse and drain period, followed by another four-second washing cycle, followed by another four-second rinse and drain period, followed by a third and final washing cycle of four seconds. After the cycle is completed, the operator pulls the empty container out of the device with the top of the can intact, triple rinsed and ready for further processing such as crushing and disposal.

The invention may be adapted for use with more than one can at a time, and the drawings illustrate a unit which permits four pesticide containers to drain and rinse simultaneously or concurrently as the operator desires. A holding tank of approximately 50 gallons contains the product drained from the containers until the operator energizes a pump to discharge its contents into whatever desired unit or system is required. A pump may be used to remove the product from the holding tank. After such removal the operator may energize a sixth circuit which will spray rinse water into the holding tank area for a period of 30 seconds. This allows the unit to be rinsed clean of product and will allow different formulations to be combined and batched for each consecutive injection.

Therefore, a primary object of the present invention is the provision of a method and means for destroying cans for other use.

A further object of the present invention is the provision of a method and means which permits the washing of the can to clean dangerous chemicals therefrom.

A further object of the present invention is the provision of an improved safety feature whereby the operator does not come in physical contact with the contents of the can accidentally.

A further object of the present invention is the provision of a device and method which improve the speed with which the cans can be punched and cleaned.

A further object of the present invention is the provision of a device which permits chemical plants to comply with current government regulations regarding proper handling of containers for pesticides and other dangerous chemicals.

A further object of the present invention is the provision of a device which will diminish the possibility of accidental spillage of the product during punching and cleaning.

A further object of the present invention is the provision of a device which permits automatic cleaning of the device itself in such a manner that the operator does not come in manual contact with the chemicals.

A further object of the present invention is the provision of a method and means which is economical, durable, and efficient in use.

BRIEF DESCRIPTION OF THE SEVERAL VIEWS OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings in which:

DETAILED DESCRIPTION OF THE DRAWINGS

Figure 1:
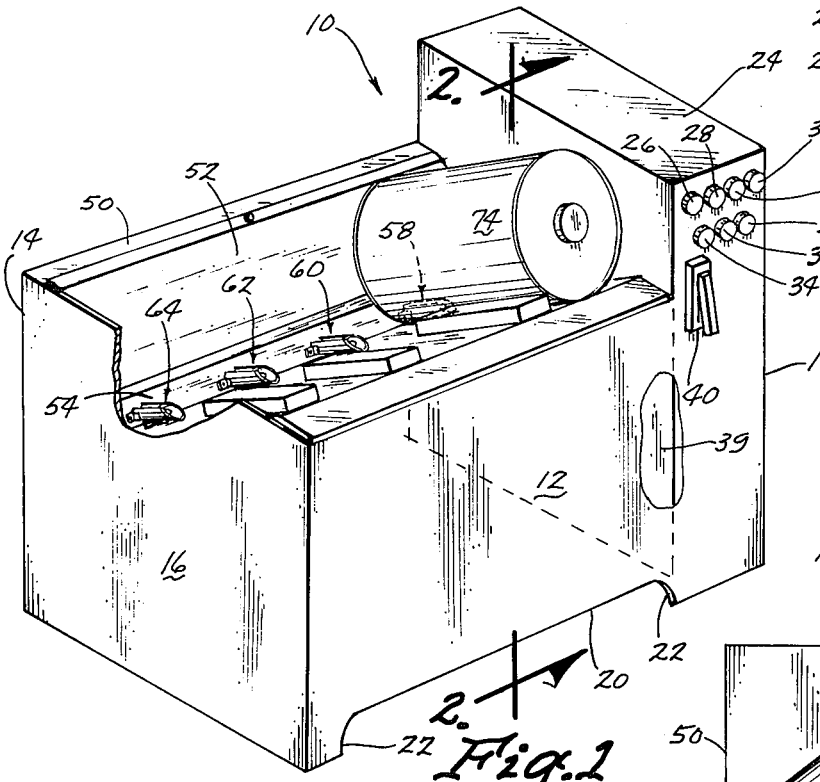
FIG. 1 is a pictorial view of the present invention.

Referring to the drawings, the can opening and washing device of the present invention is generally designated by the numeral 10. Device 10 includes a front wall 12, a rear wall 14, end walls 16, 18, a bottom wall 20, and legs 22. On one end portion of device 10 is a console 24 having a plurality of control buttons thereon. The control buttons include four can wash buttons 26, 28, 30 and 32, a motor on button 34, a motor off button 36, and a vat wash button 38. A master switch 40 is also included on the console 24. Console 24 contains the various mechanical and electrical components of device 10 and is separated from the remainder of device 10 by a bulkhead 39.

The upper portion of device 10 includes first and second inclined support walls 42, 44. First inclined wall 42 includes a horizontal flange 46 and an inclined ramp 48. Second support wall 44 includes a horizontal flange 50 and inclined ramp 52, and a recessed channel 54 at the lower end of inclined ramp 52. The lower edge of first inclined wall 42 joins with the lower edge of second inclined wall 44 so that the two ramps 48, 52 are disposed at an angle approximately perpendicular with respect to one another.

Mounted within recessed channel 54 are four can opening knives, 58,60,62, and 64. Since the structure of knives 58, 60, 62 and 64 is identical, only the structure of knife 58 will be described herein.

Figure 6:
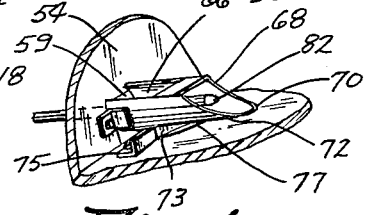
FIG. 6 is an enlarged detailed pictorial view of the knife and the spray nozzle associated therewith.
Figure 2:
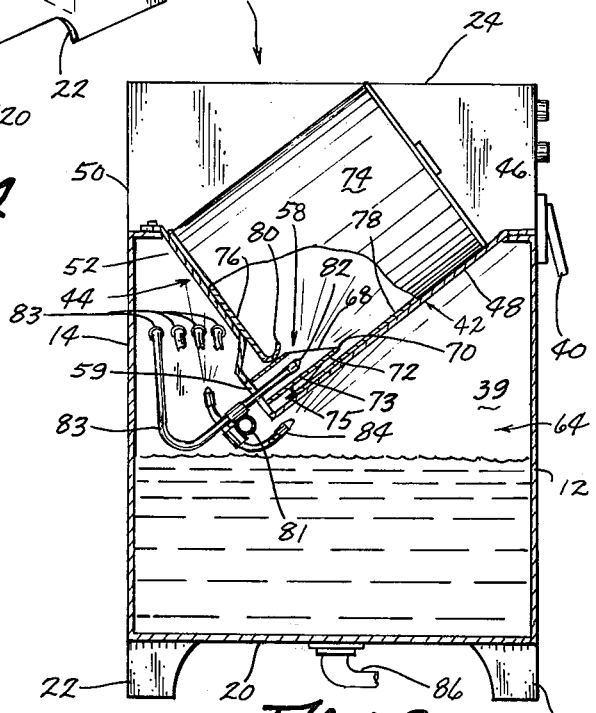
FIG. 2 is a sectional view taken along line 2—2 of FIG. 1.

Referring to FIGS. 2 and 6, knife 58 is mounted within recessed channel 54 and protrudes through an opening 59 in the wall of channel 54 so as to provide communication into the interior of a vat 64 which is defined by front and rear walls 12, 14, end wall 16, bulkhead 39, bottom wall 20, and inclined support walls 42, 44. Knife 58 is in a cylindrical shape with the upper portion open as indicated by the numeral 66 (FIG. 6). A tapered cutting edge 68 is provided on the forward end of knife 58 and terminates in a point 70. Point 70 coincides with the lower most part of knife 58 when knife 58 is viewed in cross section. The longitudinal cylindrical axis of knife 58 extends in a line parallel to inclined ramp 48 of first incline support wall 42. The lower edge 72 of knife 58 also extends in a line parallel to inclined ramp 48 and in spaced relation thereto.

Below knife 58 is a secondary knife 73 which is held in place by a bracket 75. Secondary knife 73 is in a vertical plane and includes a downwardly presented inclined cutting edge 77 which commences adjacent the forward end of knife 58 and extends downwardly to form an apex with included support wall 42.

Thus a can 74 may be placed on inclined ramp 48 in such a manner that its lower wall 76 is presented toward cutting edge 68 of knife 58. A plurality of guide channels 79 are fixed to ramp 48 to hold can 74 in the proper position. Can 74 is then manually forced against point 70 of knife 58 so that knife 58 penetrates lower wall 76 of can 74. As can be seen from FIG. 2, secondary knife 73 wedges tightly against the inner surface of side wall 78 of can 74. Most of the contents of can 74 can flow freely outwardly through the channel formed by knife 58, and the last bit of contents escape around secondary knife 73. Knife 58 and secondary knife 73 each have a slightly reduced cross-sectional size at their rearward ends so as to facilitate the escape of fluid from can 74 after knives 58, 73 have pierced it. Opening 59 in recessed channel 54 extends downwardly to the juncture with inclined wall 48 so as to permit drainage of fluid into vat 64. Opening 66 in knife 58 provides means whereby fluid can also enter the channel formed by knife 58 and flow outwardly into vat 64. As knife 58 penetrates and pierces bottom wall 76 of can 74, it forms a tab 80 which protrudes upwardly into can 74 and renders can 74 useless for containing any other products.

Extending through bulkhead 39 into vat 64 is a horizontal supply line 81 which is rigidly attached to bulkhead 39 so as to be held against movement. Supply line 81 is connected to a source of cleansing fluid. Mounted on supply line 81 are a plurality of can spray nozzles 82, each of which is held within one of the knives 58, 60, 62 and 64 such as shown in FIGS. 2 and 6. This position permits can spray nozzles 82 to spray fluid into cans 74 after they have been pierced. Can spray nozzles 82 are not in communication with supply line 81, but instead they each include an individual supply hose 83 which extends through bulkhead 39.

Also mounted on supply line 81 are a plurality of vat spray nozzles 84 which are tapped into supply line 81 so as to receive fluid therefrom. Vat spray nozzles 81 are positioned so as to spray fluid on the under surfaces of support walls 42, 44 so as to provide cleansing action thereof.

Extending outwardly through bottom wall 20 is conduit 86 which is operatively connected to a pump 88 (FIG. 5) for pumping the fluid out of vat 64 after it has accumulated therein.

Figure 3:
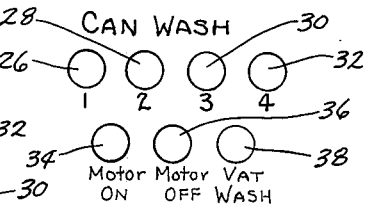
FIG. 3 is a detailed view of the control panel of the present invention.
Figure 4:
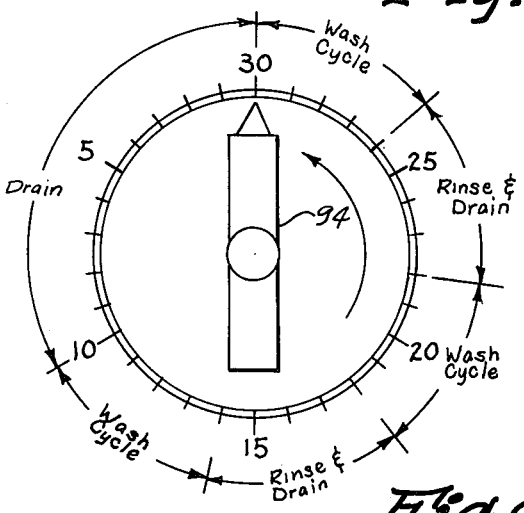
FIG. 4 is a schematic view showing the 30-second washing and rinsing cycle.
Figure 5:
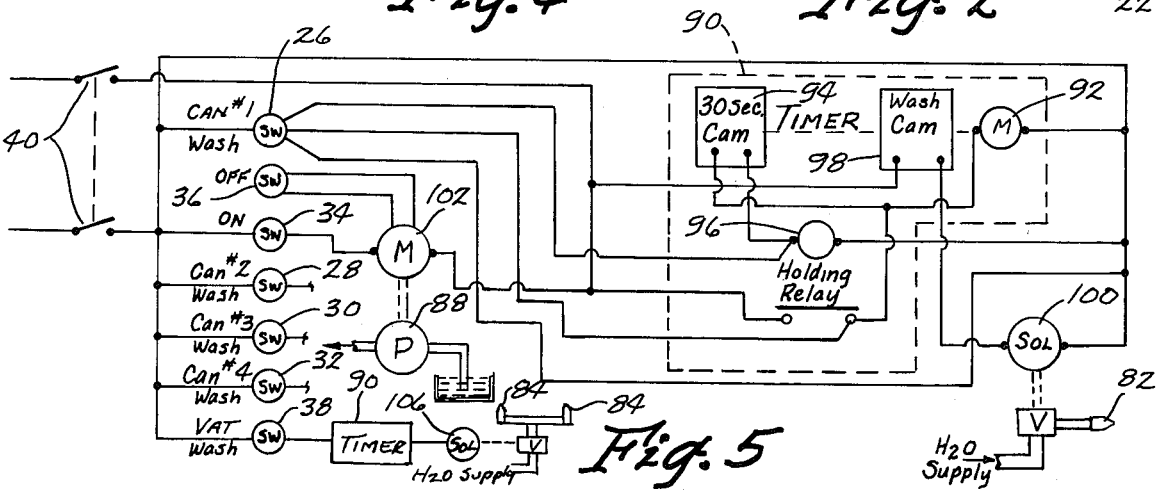
FIG. 5 is a schematic diagram illustrating the manner in which the device is actuated.

FIGS. 4 and 5 illustrate the manner in which the washing cycle operates. Device 10 is placed in an operative condition by closing master switch 40. After a can 74 has been pierced by knives 58, 73, the operator presses the can wash button for station number one which is designated by the numeral 26 in FIG. 3. Depression of this switch 26 actuates a timing mechanism designated generally by the numeral 90. Timing mechanism 90 includes a motor 92 which is actuated upon depression of switch 26 and which causes a 30-second cam 94 to begin its rotational cycle, one cycle taking 30 seconds. Cam 94 retains holding relay 96 in an activated position so as to continue the operation of motor 92 for the full 30 seconds. A wash cam 98 is shown schematically in FIG. 5, and causes alternative actuation and deactuation of solenoid 100 throughout the 30-second cycle. As shown in FIG. 4, the first 10 seconds of the cycle permits the can to drain through the channel provided by knife 58. Next, a four-second wash cycle occurs wherein solenoid 100 is actuated to cause spray nozzle 68 to spray the interior of can 74. Next follows a five-second drain cycle in which solenoid 100 is deactuated, followed by a four-second wash cycle, and then a 5-second drain cycle, and finally, a four-second wash cycle. Thus, three complete wash cycles are provided. When the cycle is complete can 74 may be removed and taken to an area for further disposal.

Depression of switches 28, 30 or 32 provides similar functions for knives 60, 62 and 64 so that four separate cans may be punched and washed simultaneously or separately as desired by the operator. After a period of time, vat 64 will fill to its capacity at which time the operator depresses the motor on switch designated by the numeral 34. Depression of this switch actuates a motor 102 which operates pump 88 and permits pump 88 to pump the contents of vat 64 outwardly through conduit 86 in bottom wall 20 of vat 64. After the content of vat 64 have been drained, the operator can press the vat wash button 38. Vat wash button 38 is connected to timer 90 in a fashion similar to the manner in which cam wash buttons 26, 28, 30 and 32 are connected thereto. The primary difference is that by depressing vat wash button 38, the operator causes timer 90 to go into its 30-second cycle so as to continuously actuate vat wash solenoid 106, thereby causing vat wash nozzles 84 to spray the interior of vat 64 for cleansing and purging thereof.

The method of the present invention comprises sliding a can to be punched onto inclined ramp 48 of wall 42. The can is pushed towards knives 58, 73 so that they pierce the lower wall thereof, with secondary knife 73 wedging against the side wall at the lowest part of the can. This permanently destroys the can and leaves a flap on the inside so that it cannot be used for containing other fluids. Next, the operator presses the appropriate can washing button and sprays the interior of the can with the knife providing the channel of escape of the fluid into the vat. The operator then removes the can from the knives for further disposal. When the vat becomes full, the operator actuates the motor on switch so as to pump the fluid outwardly from vat 64. He then actuates the vat wash button 38 so as to cause the interior of vat 64 to be sprayed continuously throughout the 30-second cycle provided by timer 90.

Thus it can be seen that the device accomplishes at least all of its stated objectives. It provides an improved safety whereby the operator does not come into physical contact with the contents of the can. It improves the speed with which the cans can be punched and cleaned inasmuch as it permits several cans to be punched and cleaned at once. It destroys the can for other use and washes the can to clean dangerous chemicals therefrom. It permits chemical plants to comply with current government regulations regarding proper handling of containers for pesticides and other dangerous chemicals, and specifically provides a three-wash cycle. It diminishes the possibility of accidental spillage of the product and permits automatic cleaning of the vat in such a manner that the operator does not come in manual contact with the chemicals. While a circular can 74 is shown in the drawings, device 10 will also accommodate rectangular cans as well.

What is claimed is:

1. A device for washing a can having lateral sides, a top, and a bottom, said device comprising;

a support having a first end and a second end for supporting said can on one of said lateral sides for sliding movement from a pre-punch position to a punch position;

a knife positioned adjacent said support and having a cutting edge presented towards said bottom of said can when said can is in said pre-punch position whereby said knife will destructively pierce said bottom of said can whenever said can is manually forced against said knife for movement to said punch position;

said knife being shaped to provide a channel for liquid contents to drain from said can whenever said can is pierced by said knife, a spray nozzle positioned within the channel of the knife so as to protrude within the interior of said can;

means connecting said spray nozzle to a source of fluid under pressure whereby said spray nozzle will spray said fluid into the interior of said can, and said support being inclined, said first end thereof being lower than said second end, said knife being positioned adjacent said first end of said support whereby the fluid contents of said can will flow towards said knife and outwardly through the hole in said can caused by said knife.

2. A device according to claim 1, wherein the lower portion of said knife is an elongated hollow cylinder, said cutting edge being at one end of said cylinder.

3. A device according to claim 2 wherein said cylinder is positioned to slide parallel to and closely adjacent the interior surface of one of said lateral walls of said can whenever said can moves to said punch position and is pierced by said knife.

4. A device according to claim 3 wherein a secondary knife is positioned under said cylinder and includes an inclined cutting edge adapted to puncture said bottom wall of said can and wedge against one of said lateral walls of said can whenever said can moves to said punch position.

5. A device according to claim 4 wherein said cylinder and said secondary knife each have a slightly reduced cross section at the other end opposite said one of said cylinder, whereby fluid may escape from said can around the outside of said cylinder and said secondary knife whenever said can is in said punch position.

6. A device according to claim 1 wherein said knife is shaped to form a fluid channel for fluid to exit from said can when said knife pierces said can, said knife being in communication with a vat for receiving the fluid contents from said can, said vat having a plurality of vat walls forming an enclosed compartment.

7. A device according to claim 6 wherein a second spray nozzle is positioned within said vat and is connected to a source of fluid under pressure for spraying the interior walls of said vat; pump means being in communication with said vat for removing the contents thereof.

8. A device according to claim 7 comprising a control means connected to said first mentioned spray nozzle for causing alternating intermittent introduction of washing fluid and rinsing fluid to said spray nozzle.

9. A device according to claim 8 wherein said control means includes timing mechanism for causing said washing and rinsing fluids to be alternatively and intermittently introduced throughout a cycle of predetermined length of time.

10. A device according to claim 1 wherein a plurality of additional knives are positioned adjacent said support, each of said knives being spaced from one another and having a cutting edge presented in the same direction as said cutting edge of said first mentioned knife, said support being sufficiently large to support a plurality of said cans in side by side relation with said bottoms of said cans each having presented towards the cutting edge of one of said knives.

11. A device for washing a can having lateral sides, a top, and a bottom, said device comprising;

a support having a first end and a second end for supporting said can on one of said lateral sides for sliding movement from a pre-punch position to a punch position;

a knife positioned adjacent said support and having a cutting edge presented towards said bottom of said can when said can is in said pre-punch position whereby said knife will destructively pierce said bottom of said can whenever said can is manually forced against said knife for movement to said punch position;

said knife being shaped to provide a channel for liquid contents to drain from said can whenever said can is pierced by said knife, a spray nozzle positioned so as to protrude within the interior of said can;

means connecting said spray nozzle to a source of fluid under pressure whereby said spray nozzle will spray said fluid into the interior of said can, said support being inclined, said first end thereof being lower than said second end, said knife being positioned adjacent said first end of said support whereby the fluid contents of said can will flow towards said knife and outwardly through the hole in said can caused by said knife, said knife being in communication with a vat for receiving the fluid contents from said can, said vat having a plurality of vat walls forming an enclosed compartment, a second spray nozzle being positioned within said vat and connected to a source of fluid under pressure for spraying the interior walls of said vat, and pump means being in communication with said vat for removing the contents thereof.

12. A device according to claim 11 comprising a control means connected to said first mentioned spray nozzle for causing alternating intermittent introduction of washing fluid and rinsing fluid to said spray nozzle.

13. A device according to claim 12 wherein said control means includes timing mechanism for causing said washing and rinsing fluids to be alternatively and intermittently introduced throughout a cycle of predetermined length of time.

* * * * *